US005978961A

United States Patent [19]

Barker

[11] Patent Number: 5,978,961

[45] Date of Patent: Nov. 9, 1999

[54] ANTI-CRUSH WORKER-SAFETY HARDJACKET

[76] Inventor: Nicholas Barker, 13311 Arikara Dr., San Diego, Calif. 92064

[21] Appl. No.: 09/059,526

[22] Filed: Apr. 10, 1998

Related U.S. Application Data

[60] Provisional application No. 60/043,358, Apr. 10, 1997.

[51] Int. Cl.[6] ..... F41H 1/02; A41D 13/00

[52] U.S. Cl. ..... 2/2.5; 2/2; 2/463; 2/464; 2/465; 2/467

[58] Field of Search ..... 2/455, 456, 462, 2/464, 465, 467, 92, 2.5, 2; 89/36.05; 428/307.4

[56] References Cited

U.S. PATENT DOCUMENTS

| | | | |
|---|---|---|---|
| 3,878,561 | 4/1975 | Winiecki | 2/2 |
| 3,991,421 | 11/1976 | Stratten | 2/2 |
| 4,422,183 | 12/1983 | Landi et al. | 2/2 |
| 4,680,812 | 7/1987 | Weigl | 2/2 |
| 5,349,893 | 9/1994 | Dunn | 89/36.05 |

*Primary Examiner*—John J. Calvert
*Assistant Examiner*—Bobby Muromoto
*Attorney, Agent, or Firm*—Robert Von Heck

[57] ABSTRACT

An improved rigid safety-vest structure intended for general use in hazardous-construction environments, such as encountered by trench and tunnel workers. Sudden cave-in situations are said by the U.S. Federal-agency O.S.H.A. to tragically take many lives annually to insidious suffocation, attributable to simple impairment of a workers'upper-abdomen/thorax region by suddenly surrounding cave-in earth. The notion of the HardJacket™ being to prevent these fatalities, by providing the worker a light-weight aerated upper-torso safety-vest within which an earthen immobilized worker can maintain their vital breathing action, -while efforts are being made to bodily extricate them. The disclosure includes a three-paneled frontally opening self-donning structure fabricated with an interlaced metal truss-structure, preferably enveloped in a bright-colored aerating nylon-fabric; plus a generic-variant embodiment, formed of inner and outer rigid-skins separated by a rigid foam-core interior. All iterations employ a comfortably flexile shoulder suspension arrangement, and may be provided with optional back-side rollers, enabling a worker to more easily scoot beneath an overhanging ledge or vehicle.

20 Claims, 2 Drawing Sheets

FIG.-1A
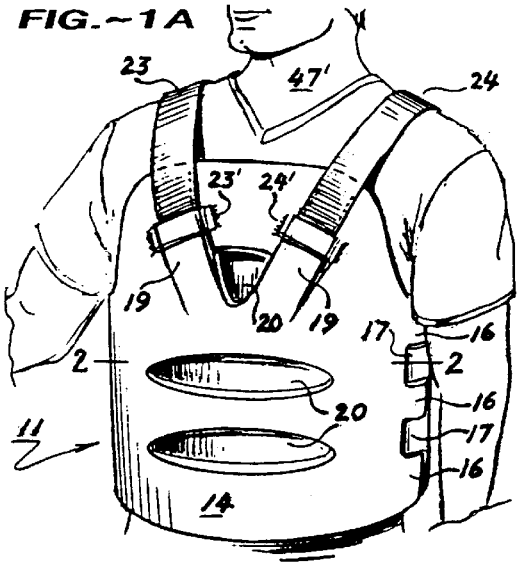
FIG.-1B
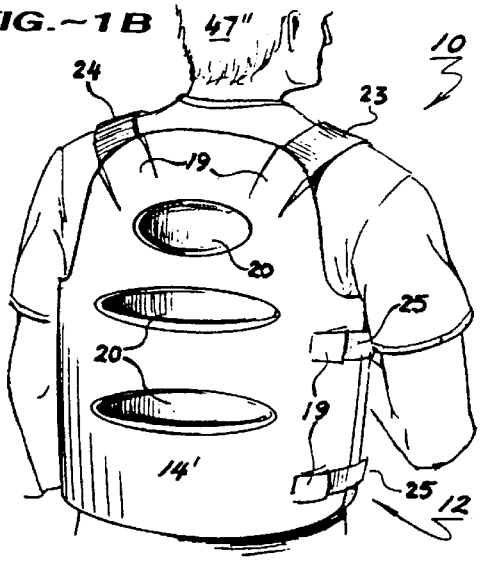
FIG.-3
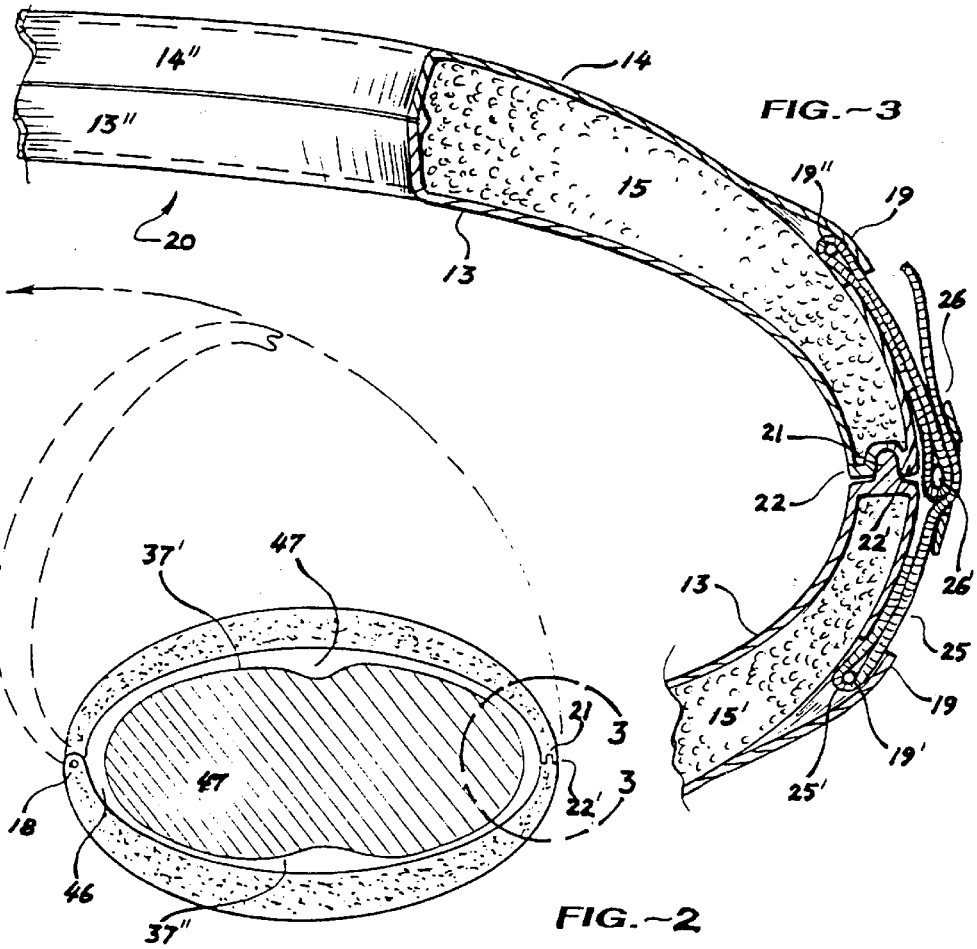
FIG.-2

FIG.-4A
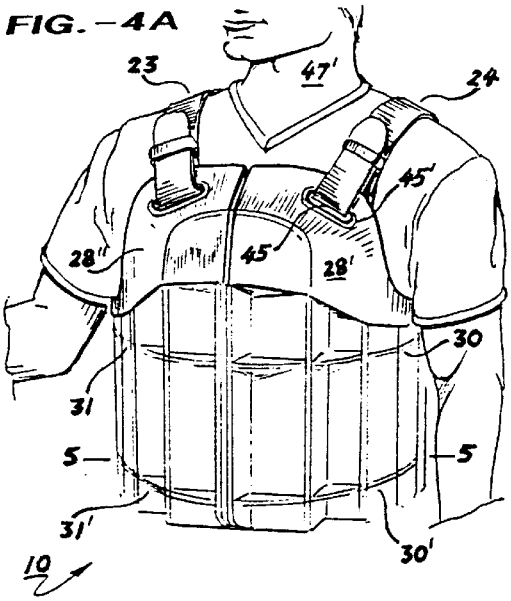
FIG.-4B
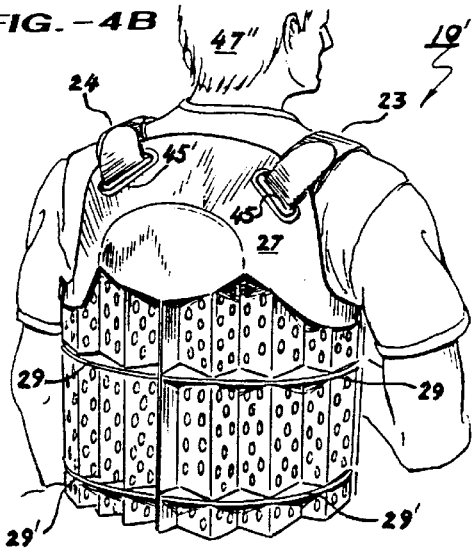
FIG.-6A
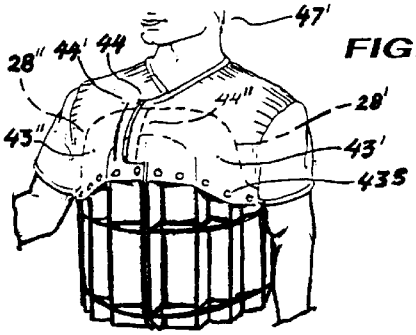
FIG.-6B
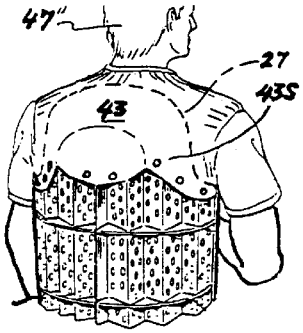
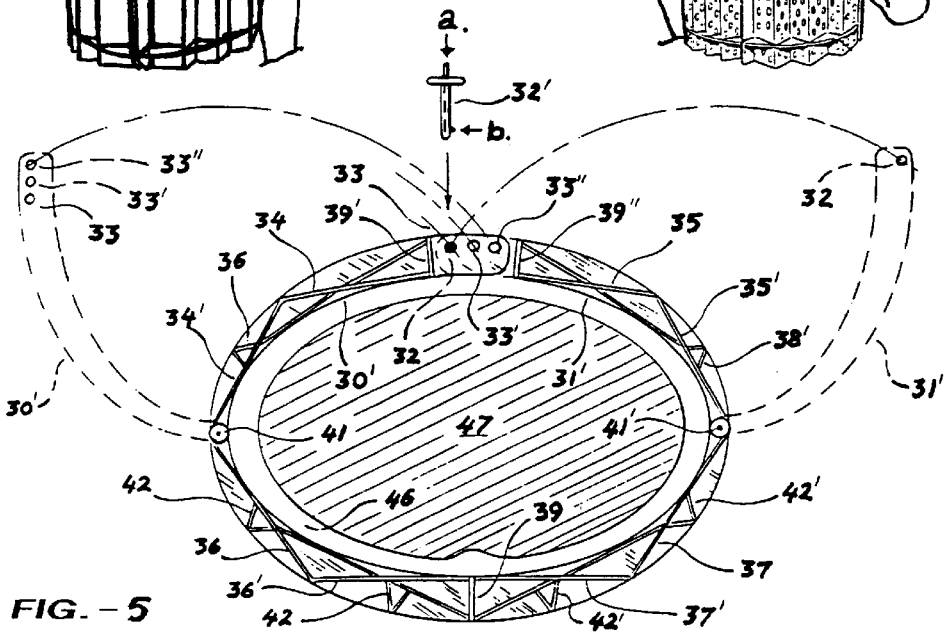
FIG.-5

ANTI-CRUSH WORKER-SAFETY HARDJACKET

This disclosure is parented by U.S. Provisional-Pat. Application No. 60/043,358 (filed: Apr. 10, 97) solely by inventor hereof.

BACKGROUND OF THE INVENTION

1. Field of Invention

This invention relates to protective gear for the human torso; and more specifically, it relates to those class of protective garments serving to obviate crushing loads imposed upon the wearer's upper-abdomen/thorax region from causing suffocating impairment of their breathing.

2. Prior Patent-Art

Background research discovery provides other prior patent-art regarded as germane. Chronologically for example, U.S. Pat. No. 989,530 (issued: April 1911) and U.S. Pat. No. 2,034,637(issued: March 1936) for underwater diving-suit apparatus worn by a persons engaging in work while subject to generally torso-crushing water-loads, which could substantially impair ones ability to breath. However, both inventions include full very-heavy body(and head) protection, which could not possibly be donned without assistance by others; and not designed to be hinged-apart for convenience.

In U.S. Pat. No. 3,162,861(filed: January 1963) is shown a "baseball batter's chest-protector" for shielding the wearer's upper/frontal-thorax (especially the heart region) from a severe external blow. Although not suspended from the shoulders, the resilient light-weight molded-plastic sheet-material backed by foam-rubber is secured to the user via a girth-adjustable horizontal-strap & buckle device extending around the user's back. However, there is no provision by which the invention could aid in preventing a surrounding crushing-load from immobilizing the wearer's breathing functions.

In U.S. Pat. No. 3,452,362(filed: April 1967) is shown a "torso armor-carrier" apparatus to be worn by a person such as a helicopter-pilot subject to flying a low-altitudes where they are vulnerable to small-arms ground fire. In order to reduce the surface-area (and commensurate weight) of armor-plate, the flackjacket invention admirably obviates aircraft armor-plate structure in favor of that which can be borne by the pilot themself. However, there is no provision by which the invention could aid in prevent breathing impairment owing to some manner of torso imposed crushing load from opposite sides to the body.

In the perhaps most relevant U.S. Pat. No. 3,777,309 (filed: March 1972), is shown a "safety garment structure" conceived to be adopted by the construction-industry. The 2-piece loose fitting rigid garment has myriad perforations for air-circulation; plus unfortunately, a large entrapping hole for wearer's neck, and entrapping holes for both arms. Constructed of solid cast metal(or plastic), the front and back panels pivot together from one side via a piano-hinge, while extending rigidly up over one's shoulders where interposing-fingers interlock the two panels; as is done on the side opposite the hinge, where it is closed via a non-adjustable latch. However praiseworthy an effort to protect a worker, the apparatus failed to provide a structure which could be worn comfortably for an extended period of time; thereby failing to fulfill industrial need for an anti-crush safety garment like article.

In U.S. Pat. No. 4,425,667(filed: January 1984) and No. 5,524,641(field: November 1994) are shown similar "protective-vest apparatus", both of which teach protective paneling which extends up and over the shoulders for suspension from the body. The earlier embodiment being devised particularly for wearing by motorcyclists, watercraft, snowmobile, and rodeo-riders; while the latter embodiment more addresses a need among intense contact-sports, such as football and hockey players. The respective apparatus both address the purpose of absorbing and dispersing otherwise traumatic impacts from objects to the torso; the earlier embodiment via more traditional materials such as contour molded ⅛ inch gauge ABS(acronitrile-butadiene-styrene)-plastic panels internally-backed by ½ inch gauge closed-cell foam such as ENSOLITE®. The latter embodiment differing particularly in that it sets forth a more high-tech paneling construction, such as myriad honeycomb or myriad geodesic-dome structural entities extending out to form the paneling. However, neither embodiment anticipates the need to protect a wearer form a crushing-load imposed from opposite sides of the body.

Finally, in U.S. Pat. No. 5,306,557(filed: February 1992) is shown best in FIG. 8 revealing a type of "composite hard-body tactical-armor" which is shown packaged much as a vest fitting close to the wearer's body without significant allowance for air-circulation and chest expansion. Because the structure is substantially flexible in nature, the illustration go indicates the wearer can avulse a hook-&-loop fastened overlapping side-panel and likewise one of the portions extending up and over the shoulders, in order to actually slip the protective garment on laterally. However, once so donned, the vest offers no apparent functional resistance to withstanding a crushing load imposed upon opposite sides (or upon all sides) of the torso.

PREVAILING PROBLEM

Because there is no commercially acceptable product presently available capable of satisfying the needs of construction-workers in the effective manner of the usually U.S. Federal OSHA/safety-standard mandated manner, such as the now familiar hardhat and steel-toed shoes, the news-media all to often bares tragic testimonial to events, where a cave-in victim could have been saved. For example, a pipe-laying trench-worker can be wearing OSHA/safety-equipment, which paradoxically, does nothing really to help the victim trapped by an earthen-trench sidewall collapsing upon them; usually enveloping and immobilizing their arms, shoulders, and neck. Cave-in victims typically cannot cry-out for help, owing the soil loading upon their chest and back has effectively knocked the air out of them, in a quiet insidious way rendering them unable to further inhale and exhale. And even If discovered in time, coworkers may not realize the critical few seconds remaining in which to try (usually in vain) to save their coworker, often believing that merely freeing the victim's face to the air will enable them to breathe. This plight has been rightfully termed "insidious compression-load suffocation", in as much as the victim may actually appear airight, eyes wide-open, mouthing in utter silence a final frantic something like . . . "help me, -I can't breath!", then shortly thereafter blacking-out from oxygen-depletion. Because even if they could exhale to take another breath, "quick-sand" like soil can promptly fill-in preventing re-expanding their upper-abdomen/thorax (action required in breathing). Whereupon, a natural panicky-trama sets-in, the victim tries to execute a last round succession of rapid mini-inhalations with all their might against the impacted earth; which is just to much, and they finally give-up from exhaustion. Meanwhile, valiant efforts to dig the victim out, generally results in further compacting the soil still tighter against the victim's torso; and, may cause still further cave-in of the adjoining trench wall region; all in all, compounding the problematical scenario. By the time professional aid can arrive, it is generally simply to late to extricate the victim for timely resuscitation. Therefore, in full consideration of the preceding patent review, there is determined a need for an improved form of device to which these patents have been largely addressed. The instant inventor hereof believes their newly improved crush protective vest device, commercially referred to as the HARDJACKET™, currently being developed for production under auspices of the Barker/R&D-Group(LLP) exhibits certain advantages as shall be revealed in the subsequent portion of this instant disclosure.

SUMMARY OF THE INVENTION

A.) In view of the foregoing discussion about the earlier invention art, and the prevailing problem, -the object of this disclosure is to provide a commercially viable solution addressing continuing need for a truly wearable "user friendly" product, which can comfortably provide reasonable physical protection for a person working where some manner of potential cave-in hazard exists. It is therefore important to make it pellucid to others interested in this art, that the object of this invention is to provide a circumferentially rigid underarm shoulder suspended torso jacket, so improved in practical terms over the preceding prior-art inventions, as to comfortably protect the wearer's body generally extending between region of the diaphragm or upper-abdomen, and upward covering the upper-chest or thorax; and necessarily, those directly opposite back regions thereof. This upper-abdomen/thorax region is the portion of the human-anatomy considered vital to performing the air-breathing process, provided one's cooperative throat/mouth/nostril region is clear of occlusion to passage of air, and the soil is prevented from exerting a constricting compressive inward force upon the victim's torso, the victim has a very good chance of surviving and going back to work the same day. Most back-hoe'ed trenches for foundations and pipe-laying are under 5-feet in vertical-depth, thus the actual weight borne upon a victim's torso can be about 750/lbs-1,200/lbs. Federal-law requires installation of reinforcement-shoring in trenches over this height; the inventor hereof advising wearing of a HARDJACKET™ in trenches over 4-feet deep, but that such a protective device is no substitute for side-shorings.

In still other instances, a sea-rescue marine, may be crushed between two boats in rough-sea, a steel-worker may be threatened while unloading beams, a mill-worker while handling logs, a demolition-worker is caught between crumbling structure, or a geologist is pinned under a collapsed overhang. These are all tasks where with foresight, and with impending liability driven sales, these workers should be wearing a HARDJACKET™ constructed to enable possible survival in a situation where otherwise, the odds for survival are dubious at best!

Accordingly, the HARDJACKET™ invention herein generally disclosed is carefully configured so as to be entirely flexible relative to shoulder movement; -that is, there is no rigid portion of the structure extending up and over the shoulders which could hinder the physical activity involved in sustaining a strenuous shoveling activity for example.

Therein was the challange, to provide a product which intrudes minimally with work-tasks, yet which is capable of sustaining an impact from a fallen tree-branch, or the weight of a collapsing framework encountered during construction or repairs. Thus, by constructing the invention without a rigid closing above the shoulders, it actually enables a worker otherwise possibly caught under a heavy collapsed-beam, a chance to escape from the HARDJACKET™ by casting the flexile shoulder-straps aside (or otherwise, be extricated by rescuers, who may have access to slice the shoulder-straps away) then squirm upwardly out of the possibly ensnared protective HARDJACKET™. The compressive-rigidity strength of the invention has been prototype tested to well withstand a 3,000/lb load, imposed both front-to-rear and side-to-side, without appreciable inward deflection (¼-inch max. diametrically). It is planned the HARDJACKET™ shall be made available in the four basic sizes of: small, medium, large, extra-large; -of unisex design (not gender specific).

B.) Another object of this invention disclosure is to set forth a preferably 3-piece personal-safety apparatus assembly capable of protecting wearer's upper-abdomen/thorax region from compression-loads (that is, loads sustained from opposite sides of the torso which are exerted in a radial direction approximately right-angles to the spinal-column); the first/protective-panel not intimately but proximally interfacing wearer's back region, the second/protective-panel hingedly dependent from the first/protective-panel while proximally interfacing wearer's left-front upper-abdomen/thorax and left underarm region;

the third/protective-panel also hingedly dependent from the first/protective-panel while proximally interfacing wearer's right-frong upper-abdomen/thorax and right underarm region.

A comfortably flexile shoulder-suspension is preferably comprised of two woven-straps, one extending over the wearer's left-shoulder, the other woven-strap extending over the right-shoulder; whereby the separate woven-straps are secured down frontally to their respective left and right protective-panel members. An alternate shoulder-suspension device is comprised of a fabric-like one-piece shoulder garment, having a front-medial left from right separation; the aftward left-portion of which extends up from the left upper portion of the mentioned first/protective-panel, and up over the wearer's left-shoulder and down where it is secured to the second/protective-panel. Likewise, the aftward right-portion of which extends up from the right upper region of the first/protective-panel and over the wearer's right-shoulder down securely to the third/protective-panel member's upper region.

An alternate generic-variant of the above structure comprises a two-piece HARDJACKET™ personal-safety apparatus assembly, comprised of rigid front and rigid rear a protective-panels not intimately but proximally interfacing the wearer's front and back region; the rigid front/protective-panel hingedly dependent at one side from the rigid back/protective-panel, and employing essentially the same configuration of shoulder-suspension outlined above.

C.) Another object of this invention disclosure is to set forth the two or three piece personal-safety HARDJACKET™ apparatus identified in paragraphs-A&B, either of which being capable of protecting wearer's upper-abdomen/thorax region from heavy compression-loads as based upon two structurally different types of construction, either of which being under ten-pounds in overall-weight.

A type-FTE(fabricated truss elements) form of construction appears almost aircraft fuselage like in embodiment, as it is comprised of plural intersecting open truss-work like preferably metal structural elements, generally unitized via oven-brazing. The resulting assemblage is inherently open to the free circulation of ambient-air, which is important to the wearer's comfort under most conditions; although it is preferred that the assemblage be covered over with an external slipover high-identity garment of brightly-colored loosely-woven fabric serving to generally block dirt from entering the interstitial region between the protective assembly ant the wearer.

In contrast, an alternate type-CPS(composite polymer sandwich) form of embodiment appears relatively straamlined in clamshell construction, as it is comprised of tough polymer-resin materials such as epoxy-resin impregnated KEVLAR® (a nylon-based aramid-fibercloth) laminant outer and inner facing substrates intimately united via a rigid light-weight foam-core (or equivalent honeycomb or geodesic interior core) uniting portion. These protective-panels (in either two or three section arrangements) are not inherently open to free passage of ambient-air, thus may include a pattern layout design of venting through-holes.

The third embodiment option is to combine the CPS and FET types of construction, for example providing a back/protective-panel in CPS with a single or dual front/protective-panel in FET; whereby owing to the very open FET frontal structure, the back CPS panel may be substantially imperforate; -or arranged vice versa, CPS in front, FET at rear. Since either type of construction can be made sufficiently rigid as to withstand significant crushing loads, the inventor hereof believes it is largely up to the engineering-designer to determine the particular manner of construction most suitable for their workplace-task application. The possible advantage for the FET-type construction executed in aircraft-grade aluminum-alloy, resides in it's non-aging quality after being exposed to the sun's ultraviolet-rays for years.

D.) Another object of this invention disclosure is to set forth a girth-retention device suitable for either the 2-piece or 3-piece personal-safety HARDJACKET™ apparatus identified in paragraphs-A&B, and types of construction outlined in paragraph-C; whereby a wearer manually guides the distally opposite circumferential ends of the HARDJACKET™ securely together at the frontal vertical median where the vertical margins of the left and right protective-panels converge; -thereby securing the HARDJACKET™ to it's wearer until removal be desired. Although a number of suitable latching devices are known, the two girth-retention devices presently presented herein are:

a.) a plural arrangement of incrementally spaced apart vertical adjustment-bores of a common size rigidly mounted proximal the vertical-margin of the second/protective-panel. An opposite interposing vertical key-bore of the same common size, is rigidly mounted proximal the adjoining vertical-margin of the third/protective-panel; whereby the second and third protective-panels are therefore able to be interposed one to the other until the most suitable girth sizing fitment is realized. Then, a vertical latch-pin is inserted down through both the key-bore and one of the selected adjustment-bores, thereby attaining a positive link-up of the second and third protective-panels, while cooperatively coupled with the first/protective-panel. The latch-pin is preferably of a substantially conventional self-locking so-called bayonet-type clevis-pin, employing a spring-loaded coaxial secondary-pin which abaxially-biases an interference-ball, preventing extraction of the latch-pin from the bore until the secondary-pin is shifted sufficiently enabling the interference-bali to momentarily radially-retract into the shank of the latch-pin, whereby the latch-pin may be withdrawn from the selected bore; or, some alternate girth-retention device of choice.

b.) comprising a vertical-tongue formed upon one of the two circumferentially distal ends of the HARDJACKET™, and a corresponding vertical-groove formed upon the opposite distal end thereof; the aggregate tongue-&-groove members being held intimately engaged via an overlapping arrangement of a substantially conventional belt-&-buckle arrangement, or a substantially conventional hook-&-loop fastener arrangement.

III.) DESCRIPTION OF THE PREFERRED EMBODIMENT DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the Claims section annexed hereto; and accordingly, a better understanding of the invention and the variant uses is intended, by reference to the drawings, which are considered as primarily exemplary and not to be therefore construed as restrictive in nature; wherein:

FIG. 1 A, is a ¾-front pictorial-view of an exemplified clean-lined appearing embodiment for a two protective-panel version of the invention employing CPS-type construction, including phantom outline of a human-form thereto for reference as to the flexile shoulder suspension arrangement employed therewith;

FIG. 1 B, is a ¾-rear pictorial-view thereof, favoring the wearers left side;

FIG. 2, is a slightly enlarged cross-sectional top/plan-view thereof, referenced 2:2 in FIG. 1A, and demonstrating the cooperative relationship of the dual protective-panel embodiment in installed condition encircling a wearer's body, including a phantom-outline indication of frontal protective-panel hinging action;

FIG. 3, is a 6X-enlarged cross-section thereof, referenced 3:3 in FIG. 2;

FIG. 4A, is a ¾-front pictorial-view of an exemplified embodiment for a three protective-panel version of the invention employing FTE-type construction, including phantom outline of a human-form thereto for reference as to a flexile shoulder suspension arrangement therewith;

FIG. 4B, is slightly enlarged a ¾-rear pictorial-view thereof, favoring the wearers left side;

FIG. 5, is a slightly enlarged cross-sectional top/plan-view thereof, reference 5:5 in FIG. 4A, and demonstrating the cooperative relationship of the three protective-panel embodiment in installed condition encircling a wearer's body, including a phantom-outline indication of both frontal protective-panels hinging action, as well as their girth-adjustment geometry;

FIG. 6A, is a frontal-view according to FIG. 4A, showing an alternate shoulder suspension arrangement for the invention;

FIG. 6B, is a rear-view thereof.

ITEMIZED NOMENCLATURE REFERENCES

10'/10"—overall hardiacket invention (CPS-type/FTE-type)

11,11'/11"—front/protective-panel (2-piece model/3-piece model: left/right)

12,12'—rear/protective-panel (2-piece embodiment/ 3-piece embodiment)

13/13',13"—panel inner-skin substrate (fnt.panel/rear panel), butting-flange
14/14',14"—panel outer-skin substrate (fnt.panel/rear panel), butting-flange
15/15'—panel core substrate (fnt.panel/rear panel)
16—trailing hinge segment (fnt.panel)
17—leading hinge segment (rear panel)
18—hinge-pin axis (common)
19,19'/19"—integral strap-moorings, strap anchor-pin (front/rear)
20—ventilation apertures
21—vertical tongue
22/22'—vertical groove (inside/outside)
23,23'—right shoulder-strap, quick-release buckle
24,24—left shoulder-strap, quick-release buckle
25,25'—anchor-strap (rear protective-panel), wrap-around portion
26,26'—quick-release buckle & strap (front protective-panel), wrap-around portion
27—FTE rear armature
28,28'—FTE front armature (left/right)
29,29'—FTE rear horizontal-ribs (upper/lower)
30/30'—FTE front-left horizontal-ribs (upper/lower)
31/31'—FTE front-right horizontal-ribs (upper/lower)
32,32'—key-bore, latch-pin
33,33'/33"—vertical-axis of adjustment-bores
34/34'—front-left FTE main-truss members (leading/trailing)
35/35'—front-right FTE main-truss members (leading/trailing)
36/36'—rear-left FTE main-truss members (leading/trailing)
37/37'—rear-right FTE main-truss members (leading/trailing)
38/38'—front vertical-stiffener members (left/right)
39,39'/39"—FTE vertical-ribs (rear, front-left/front-right)
40—aeration/lightening-holes
41/41'—vertical hinge-axis (left/right)
42/42'—rear vertical-stiffener members (left/right)
43,43'/43"—shoulder hanging garment (rear, front: left/right)
44,44'/44"—zipper, plus two alternate 2-zipper portions (2nd/3rd)
45,45'—strap mooring-slots, soft-edging
46—interstitial spacing
47,47/47"—upper-abdomen/thorax region, human wearer (front-aspect/rear-aspect)

V.) DETAILED DESCRIPTION OF THE PREFERRED EMBODIMENTS

Initial reference is given by way of FIG'S. 1A/1B, wherein is exhibited the considered most clean-lined embodiment of the overall invention 10', which in this iteration employs a 2-piece CPS-type protective-paneling based upon substantially conventional known composite polymer sandwich type construction; providing a rigid albeit light-weight component. The front view aspect FIG. 1A exhibits front-half protective-panel 11, while FIG. 1B exhibits the cooperating rear-half protective-panel 12, joined at one side by a preferably integrally-formed interposed-hinge arrangement comprised of trailing front hinge segments 13 and rear leading hinge segments 14, joined by hinge-pin 15. Both panels 11 and 12 preferably employ high-strength Kevlar® (epoxy resin impregnated) laminants for both the inner substrate skin 14 and outer substrate skin 15, which are united via a core 16 made of a light-weight compression-resistive substrate. The essential function of core 16 being to space the respective protective-panel's external skins 14 and 15 sufficiently apart (materials remaining the same, the greater the spacing, the more rigid the part) as to achieve the amount of protective-panel resistance to bending needed to rigidly sustain a CLR(crushing-load rating) of generally to 1½-ton(3,000/lbs) applied from any azimuth direction relative to it's standing wearer.

In a much as a wearer of the HARDJACKET™ may be found knocked from standing or kneeling, to a prone (or supine) position, a more appropriate term than "azimuth" is required when referring to "a crushing-load squeezing-in from opposite sides" at a direction approximately radial to wearer's spinal-column. Hence, the technical designation of: "CLR: 1.5T/SCR" (spinal-column radian) is more appropriate to define that the HARDJACKET™ can for example withstand a cave-in loading of 3,000-lbs.S(sustained) and perhaps to 5,000-lbs.SI(sudden-impact). Presently, no federal OSHA strength-standards have yet been clearly established for the HARDJACKET™, thus the inventor hereof has also determined a preliminary so called 1½-ton provision (plus, having a safety-margin factor of 160% for 24 hrs. @ 40°–120° F.), for versions of the product intended to provide its wearer general safety against trench cave-in environment hazard usage for example. An assembled product weight of under 10-lbs. is also considered a vital guideline factor toward meeting prolonged user comfort; and a slight initial (upon sustaining the load) circumferential max.-deflection (¼-inch diametrically inward) is permissible.

Study of FIG. 2 further shows the CPS-type HARDJACKET™ clearly revealing the construction of the front 11 and rear 12 protective-panels, being similar in basic structural character but employing slightly different contouring as to better interface with the general physiognomy of the human-torso's front and back. In as much as there is a considerable percentile variance encountered in the variety of human body shapes (I.E.—long-waisted/short-waisted, large-chested/small-chested(girth), trim-waisted/thick-waisted (girth), etc.). For most working applications. there is a need to promote ambient-air circulation between the respective panels and the body of the wearer, thus a nominal interstitial space 36 of about ¾ inch is desired: thereby enabling ambient-air to circulate through via various front and rear formed ventilation-apertures 20. Additionally, FIG. 2 shows how respective panel skins 14 and 15 are preferably formed accurately, whereby outer-skin substrate 15 is contoured to a generally tighter radius than its inward facing counterpart 14. This resultingly tapered variation in core 16 thickness serves to achieve a form of variable beam thickness, which is an effective way of reducing bulk (approx. 1-in. min.-thickness) at the left and right lateral side regions of the HARDJACKET™, while maintaining the greater bulk of thickness in the central chest (approx. 1½-ins. max.-thickness) and back (approx. 2½-ins. max.-thickness) regions where a greater thickness does not usually interfere much with one's working space. By way of structural comparison, one can perhaps best envision a truss-bridge structure, wherein the sidewalls rise to their greatest height mid-stream, tapering down substantially at their extreme opposite ends.

Reference to FIG. 3 reveals the composite structure in greater detail, wherein the preferred dove-tail like girth-retention structure includes a vertical male-tongue entity 21 which swings horizontally (via hinge-axis 18 in FIG. 2) into the vertical female-slot formed by adjacent vertical-groove formation entities 22 and 22'. Holding the tongue-&-groove arrangement intimately together is the preferable arrangement of lateral cinching-straps 25 working in cooperation with conventional quick-release type strap buckles 25'. Note also how the ventilation apertures 20 of the CPS-type protective-panels 14/14' are constructed with inwardly interfacing and abutting aperture flanges 14" (formed from outer-skin substrate 14) and 13" (formed from inner-skin substrate 13); thereby serving to maintain the structural integrity of the assembly. While shown here as a myriad closed-cell filling substrate, the panel core 15 can be made of any light-weight filling such as conventional honeycomb or geodesic-dome inter-structures capable of unitedly reinforcing the perferably KEVLAR® inner-skin 13 and outer-skin 14.

There remain subtle, however vital other differences which are to become herein more evident and understood as further important features; for example, FIG'S. 4A&4B show a generic-varient embodiment referred to as the FTE-type HARDJACKET™, owing that it features a unique "fabricated-truss element" form of construction. Although it could be made in a 2-piece configuration hinging open according to FIG. 2, this 3-piece configuration hinges open upon opposite lateral vertical hinge-axes 41 and 41' as shown in FIG. 5, the advantage of double hinging enabling an optional girth-adjustment provision. Once donned by wearer 47' (per FIG'S. 4A/6A), one may readily regulate the degree of closure, achieved here by merely selecting one of preferably three different adjustment-bore settings, employing vertical-axes 33/33'/33" staged proximal the inboard terminus of protective-panel horizontal-rib 30', and in vertical-axis alignment with the key-bore 32 of horizontal-rib 31'. In FIG. 5 we observe that key-bore 32 has been aligned vertically with adjustment-bore 33, but selecting other bores 33'/33" would thereby regulate the protective-panel medial opening to facilitate a greater girth dimension; whereupon the latch-pin 32' is inserted vertically there through. This preferred type of locking-pin device is of the type often employed with a clevis, and features a convenient spring-loaded external button-plunger (a.) which is depressed by one's thumb to obtain release of partially protruding retention-ball (b.), in order to insert or extract the locking-pin shank from one of the slip-fitting adjustment-bores 33/33'/33" and coaligning key-bore 32. Accordingly, both horizontal-ribs 31/31' of protective-panel 11', and 30/30' of protective-panel 11', are to be made in this manner. The latch-pin 32' is usually connected to horizontal-rib 31' via a short lanyard (3-inch nylon cord, not shown) preventing inadvertent loss.

Study of FIG. 5 also best conveys the exemplified truss-element structural principle, wherein for example in the fabrication of the component protective-panel 11", main-truss members 34 & 34' are tack-welded to intersect upon horizontal-ribs 31/31'; as are various other structural elements such as vertical-stiffener member 38' vertical-rib 39", the upper-right armature, and a trunnion like outboard terminus associated with hinging-axes 41. This tack-welded aggregation preferably comprised of sheet-aluminum elements, is preferably then enmasse oven-brazed into a unified structurally very rigid light-weight final component. The substantially like elements of the corresponding left-side front protective-panel 11' is made in the same manner (the nomenclature-section identifies these near mirror-image elements); as are the likewise assembled elements associated with fabrication of the rear protective-panel component 12' which utilizes an undivided upper armature portion 27. With all three components, their armature portions serve to provide an extra amount of strength by virtue of the armature's thin sheet-metal (preferably aluminum, aircraft-fuselage like) stressed-skin quality. While the shoulder-strap suspension arrangement is similar to that shown with the CPS-type construction of FIG'S 1A/1B, the mooring-slots 45 formed through the armatures 27/28'/28" preferably include a softer-plastic edging or the type having a C-shaped cross-section. As with the CPS-type embodiment of FIG. 2, it is desired to provide an ample amount of interstitial space 46 between wearer's upper-abcomen/thorax region 47 and the inward facing portions of the donned HARDJACKET™, as to promote the circulation of ambient-air.

Note also, in some cases it may be desirable to mix-and-match types of construction; that is, assemble a somewhat hybrid version of the HARDJACKE™, possibly employing a combination of both CPS and FTE types of construction. For example, a CPS-type rear protective-panel 12 may be provided with the opposed lateral hinge-axis 41/41' arrangement shown here with the FTE-type frontal protective-panels 11'/11"; or conversely, a design-engineer may prefer to employ but a single frontal protective-panel 11, and instead, constructed in the manner of the exemplified FTE-type structure, and in combination with a rear protective-panel 12 made according to CPS-type construction. Since exemplified hinging arrangements are to be suitably substituted, a variety of combinations may be realized, suiting various design and environmental requirements.

An alternate shoulder-suspension method is shown in FIG'S. 6A/6B employing a "tank-top" like garment preferably of durable nylon/fabric-mesh, in stead of shoulder-straps 23/24; the removably washable shoulder-garment effectively distributing the weight of the HARDJACKET™ more evenly across the wearer's shoulders. While frontal fabric portions 43'/43" are made contiguous with back portion 43, the front portions preferably include a medial vertical zipper 44, preferably provided with alternate vertical half-zipper mating portions 44' (2nd) 44" (3rd) arranged as to correspond with FIG. 5 exemplified adjustment-bore positions 33/33'/33"; thereby making for a very neatly arranged frontal assembly, regardless as to the wearer's suitably determined girth adjustment requirement. The suspension-garment is attached to the upper armature portions 28/28'/28" of the HARDJACKET™ via a plurality (eighteen indicated) of standard commercially available button-like snap-fasteners 43S preferably spaced along the lower edge of the armature structure. Snap-fasteners 43S are preferably of the type bearing the notation "lift at dot", which are designed to detatch from it's circular female-portion only if the pull is from a certain direction, thereby holding fast relative to any amount of vertical-loading.

Thus, it is readily understood how the preferred and generic-variant embodiments of this invention contemplate performing functions in a novel way not heretofore available nor realized. It is implicit that the utility of the foregoing adaptations of this invention are not necessarily dependent upon any prevailing invention patent; and, while the present invention has been well described hereinbefore by way of certain illustrated embodiments, it is to be expected that various changes, alterations, rearrangements, and obvious modifications may be resorted to by those skilled in the art to which it relates, without substantially departing from the implied spirit and scope of the instant invention.

Therefore, the invention has been disclosed herein by way of example, and not as imposed limitation, while the appended Claims set out the scope of the invention sought, and are to be construed as broadly as the terminology therein employed permits, reckoning that the invention verily comprehends every use of which it is susceptible.

What is claimed of proprietary inventive origin is:

1.) A three-piece hardjacket personal-safety apparatus assembly to be worn where cave-in hazard exists, protecting wearer's upper-abdomen/thorax region from potential insidious compression-load suffocation until rescued; said personnel saftey apparatus comprising:

a rigid first/protective-panel not intimately contracting but proximally interfacing wearer's back region;

a rigid second/protective-panel hingedly connected to from said first/protective-panel, while not intimately contracting but proximally interfacing wearer's left-front upper-abdomen/thorax and left-underarm region;

a rigid third/protective-panel hingedly connected to from said first/protective-panel, while not intimately contracting but proximally interfacing wearer's right-front upper-abdomen/thorax and right-underarm region;

a comfortably flexile shoulder-suspension means arranged between said first/protective-panel and both said second/protective-panel and said third/protective-panel;

a girth-retention means, enabling wearer to rigidly secure the distally opposite circumferential terminus margins of said second/protective-panel to said third/protective-panel at the front medial region of the body of the wearer, and conversely, said girth-retention means enabling wearer to manually detach said second/protective-panel from said third/protective-panel, whereby wearer may hingedly swing-apart respective said second and third protective-panels as to extricate themself from said hardjacket.

2.) The personnel safety apparatus according to claim 1, wherein said first/protective-panel comprises a composite plurality of intersecting open truss-work like structural elements joined rigidly together, through which ambient-air is free to circulate.

3.) The personel safety apparatus according to claim 1, wherein said second/protective-panel comprises a composite plurality of intersecting open truss-work like structural elements joined rigidly together, through which ambient-air is free to circulate.

4.) The personel safety apparatus according to claim 1, wherein said third/protective-panel comprises a composite plurality of intersecting open truss-work like structural elements joined rigidly together, through which ambient-air is free to circulate.

5.) The personel safety apparatus according to claim 1, wherein said shoulder-suspension means is comprised of two woven-straps, one woven-strap extending over wearer's left-shoulder the other woven-strap extending over wearer's right-shoulder.

6.) The personel safety apparatus according to claim 1, wherein said shoulder-suspension means is comprised of a one-piece shoulder garment including front medial left from right separation, the afterward left-portion of which extends up from the left upper region of said first/protective-panel and over wearer's left-shoulder down securely to said second/protective-panel, the afterward right-portion of which extends up from the right upper region of said first/protective-panel and over wearer's right-shoulder down securely to said third/protective-panel.

7.) The personel safety apparatus according to claim 1, wherein said first/protective-panel means is comprised of a composite polymer-resin structure having an outward-facing skin discrete from an inward-facing skin, and including a rigidly uniting light-weight core means permanently bonded there between said skins.

8.) The personel safety apparatus according to claim 1, wherein said second/protective-panel comprises a composite polymer-resin structure having an outward-facing skin discrete from an inward-facing skin, and including a rigidly uniting light-weight core means permanently bonded there between said skins.

9.) The personel safety apparatus according to claim 1, wherein said third/protective-panel comprises a composite polymer-resin structure having an outward-facing skin discrete from an inward-facing skin, including a rigidly uniting light-weight core means permanently bonded there between said skins.

10.) The personel safety apparatus according to claim 1, wherein said girth-retention means is a vertical tongue means engages with a vertical groove means thereby forming an interlocking tongue and groove joint between said second/protective-panel and said third/protective-panel, said tongue and groove joint held intimately engaged via an overlapping arrangement of conventional buckled straps or via an overlapping conventional hook and loop fastener.

11.) The personel safety apparatus according to claim 1, wherein said girth-retention means includes a girth-adjustment means, thereby facilitating better fitting of said personal safety apparatus assembly to the torso girth of individual wearers.

12.) The personnel safety apparatus according to claim 11, wherein said girth-adjustment means comprises a plural arrangement of incrementally spaced apart vertical adjustment-bores of common size rigidly mounted proximal to the margin of said second/protective-panel, and an oppositely interposing vertical key-bore of said common size rigidly mounted proximal to an adjoining margin of said third/protective-panel; whereby said second and third protective-panels are therefore able to be interposed one to the other until the desired girth is realized, whereupon a vertical latch-pin is vertically inserted through vertical said key-bore and one of the adjustment-bores, thereby attaining a positive link-up of said second/protective-panel to said third/protective-panel.

13.) The personnel safety apparatus according to claim 12, wherein said latch-pin is of a bayonet-type.

14.) The personnel safety apparatus according to claim 1, wherein said personal safety apparatus includes an external slipover high-identity garment of brightly-colored loosely-woven fabric serving to generally block dirt from entering said proximal interfacing region between the wearer and said safety apparatus.

15.) A three-piece hardjacket personal-safety apparatus assembly to be worn where cave-in hazard exists, protecting wearer's upper-abdomen/thorax region from potential insidious compression-load suffocation until rescued; said personal safety apparatus comprising:

a rigid first/protective-panel comprising a composite plurality of intersecting open truss-work like structural elements joined rigidly together, through which ambient-air is free to circulate, and not intimately contracting but proximally interfacing wearer's back region;

a rigid second/protective-panel comprising a composite plurality of intersecting open truss-work like structural elements joined rigidly together, through which ambient-air is free to circulate, and hingedly connected to said first/protective-panel, while not intimately contracting but proximally interfacing wearer's left-front upper-abdomen/thorax and left-underarm region;

a rigid third/protective-panel comprising a composite plurality of intersecting open truss-work like structural elements joined rigidly together, through which ambient-air is free to circulate, and hingedly connected to said first/protective-panel, while not intimately contracting but proximally interfacing wearer's right-front upper-abdomen/thorax and right-underarm region;

a comfortably flexile shoulder-suspension means arranged between said first/protective-panel and both said second/protective-panel and said third/protective-panel;

a girth-retention means, enabling wearer to manually attach said second/protective-panel rigidly with said third/protective-panel, thereby securing aggregate said protective-panels proximally around wearer; and conversely, said girth-retention means enabling wearer to manually detach said second/protective-panel from said third/protective-panel, whereby wearer may hingedly swing-apart respective said second and third protective-panels as to extricate oneself from said hard-jacket.

16.) The personnel safety apparatus according to claim 15, wherein said girth-retention means comprises a plural arrangement of incrementally spaced apart vertical adjuster-bores of common size rigidly mounted proximal to the inboard-margin of said third/protective-panel, and an oppositely interposing vertical key-bore of said common size rigidly mounted proximal to the adjoining inboard-margin of said second/protective-panel; whereby said second and third protective-panels can be manually interposed one to the other until a suitable girth sizing is realized, whereupon a vertical latch-pin is vertically inserted through vertical said key-bore and one of the adjuster-bores, thereby attaining a positive link-up of said second/protective-panel to said third/protective-panel.

17.) The personnel safety apparatus according to claim 16, wherein said vertical latch-pin is of a bayonet-pin type.

18.) The personnel safety apparatus according to claim 15, wherein said shoulder-suspension means comprises of two woven-straps, one woven-strap extending over wearer's left-shoulder, the other woven-strap extending over wearer's right-shoulder.

19.) The personnel safety apparatus according to claim 15, wherein said shoulder-suspension means comprises a one-piece shoulder garment including front medial left from right separation, the afterward left-portion of which extends up from the left upper region of said first/protective-panel and over wearer's left-shoulder down securely to said second/protective-panel, the afterward right-portion of which extends up from the right upper region of said first/protective-panel and over wearer's right-shoulder down securely to said third/protective-panel.

20.) A two-piece hardjacket personal-safety apparatus assembly to be worn for example where cave-in hazard exists, protecting wearer's upper-abdomen/thorax region from potential insidious compression-load suffocation until rescued; said apparatus personal safety comprising:

a rigid rear/protective-panel means not intimately connected but proximally interfacing wearer's back region;

a rigid front/protective-panel means hingedly connected to one lateral side from said first/protective-panel, while proximally interfacing wearer's front-right and front-left upper-abdomen/thorax regions;

a comfortably flexile shoulder-suspension means arranged between said rear/protective-panel and said front/protective-panel;

a girth-retention means, enabling wearer to attach said rear/protective-panel rigidly to said front/protective-panel, thereby securing said hardjacket proximally around the wearer; and conversely, said girth-retention means enabling wearer to manually detach said rear/protective-panel from said front/protective-panel, whereby wearer may hingidly swing-apart respective said front/protective-panel from said rear/protective-panel as to manually extricate oneself from said hard-jacket.

* * * * *